US009872547B2

(12) United States Patent
Naiva

(10) Patent No.: US 9,872,547 B2
(45) Date of Patent: Jan. 23, 2018

(54) HANDLE ASSEMBLY FOR A CASE

(71) Applicant: Milwaukee Electric Tool Corporation, Brookfield, WI (US)

(72) Inventor: Matthew W. Naiva, Wauwatosa, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 0 days.

(21) Appl. No.: 15/361,271

(22) Filed: Nov. 25, 2016

(65) Prior Publication Data

US 2017/0143090 A1 May 25, 2017

Related U.S. Application Data

(60) Provisional application No. 62/259,859, filed on Nov. 25, 2015.

(51) Int. Cl.

| | |
|---|---|
| ***A45C 13/26*** | (2006.01) |
| ***A45C 5/14*** | (2006.01) |
| ***B25H 3/02*** | (2006.01) |

(52) U.S. Cl.

CPC ..... *A45C 13/262* (2013.01); *A45C 5/14* (2013.01); *B25H 3/02* (2013.01); *A45C 2013/267* (2013.01)

(58) Field of Classification Search

CPC ..... Y10T 16/451; Y10T 16/473; A45C 13/26; A45C 13/262; A45C 2013/26;

(Continued)

(56) References Cited

U.S. PATENT DOCUMENTS

| | | | |
|---|---|---|---|
| 1,275,862 | A | 8/1918 | Danz |
| 2,042,387 | A | 5/1936 | Cobb |

(Continued)

FOREIGN PATENT DOCUMENTS

| | | |
|---|---|---|
| DE | 202012102834 | 8/2012 |
| EP | 0195651 | 9/1986 |

(Continued)

OTHER PUBLICATIONS

SKB cases, I Series Indestructible Catalog (2010) 16 pages.

(Continued)

*Primary Examiner* — Chuck Mah

(74) *Attorney, Agent, or Firm* — Michael Best & Friedrich LLP

(57) ABSTRACT

A telescoping handle assembly, a mobile device, and a method of assembling a telescoping handle assembly for a mobile device. The handle assembly may include a first handle section, and a second handle section telescopingly arranged relative to the first handle section. The handle assembly may further include a latch assembly fixed to one of the first handle section and the second handle section and selectively engageable with the other of the first handle section and the second handle section. The latch assembly may include a latch body positioned between the first handle section and the second handle section and a shock-absorbing mount positioned between the latch body and the one of the first handle section and the second handle section.

20 Claims, 6 Drawing Sheets

(58) Field of Classification Search
CPC ..... A45C 2013/267; A45C 2013/262; A45C 5/14; B62B 5/06; B62B 5/067; B62B 5/065; B25H 3/02
See application file for complete search history.

(56) References Cited

U.S. PATENT DOCUMENTS

| | | | |
|---|---|---|---|
| 2,125,856 | A | 8/1938 | De Witt |
| 2,145,143 | A | 1/1939 | Trecartin |
| 2,463,713 | A | 3/1949 | Partiot |
| 2,799,306 | A | 7/1957 | Martin |
| 2,826,426 | A | 3/1958 | Vaughn |
| 2,883,184 | A | 4/1959 | Brewington |
| 3,177,023 | A | 4/1965 | Nuckols |
| 3,259,411 | A | 7/1966 | Griffiths |
| 3,394,955 | A | 7/1968 | Martin |
| 3,446,304 | A | 5/1969 | Alimanestiano |
| 3,606,372 | A | 9/1971 | Browning |
| 3,817,419 | A | 6/1974 | Moller et al. |
| 3,842,953 | A | 10/1974 | Royet |
| 3,851,756 | A | 12/1974 | Brown |
| 3,924,844 | A | 12/1975 | Bachtel, Jr. |
| 3,948,365 | A | 4/1976 | Gregg et al. |
| 3,989,128 | A | 11/1976 | Walker |
| 3,997,038 | A | 12/1976 | Walker |
| 4,036,336 | A | 7/1977 | Burtley |
| 4,062,429 | A | 12/1977 | Tabor et al. |
| 4,087,102 | A | 5/1978 | Sprague |
| 4,105,112 | A | 8/1978 | Graf |
| 4,222,580 | A | 9/1980 | Krokonko |
| 4,228,877 | A | 10/1980 | Cothary |
| D258,705 | S | 3/1981 | Wheeler |
| 4,254,850 | A | 3/1981 | Knowles |
| 4,261,447 | A | 4/1981 | Arias et al. |
| D259,154 | S | 5/1981 | White, Jr. et al. |
| 4,278,187 | A | 7/1981 | Luedtke |
| 4,288,134 | A | 9/1981 | Knaack et al. |
| 4,353,182 | A | 10/1982 | Junkas et al. |
| D272,203 | S | 1/1984 | Di Bartolo |
| 4,561,526 | A | 12/1985 | Winter et al. |
| 4,566,616 | A | 1/1986 | Rise |
| 4,575,109 | A | 3/1986 | Cowdery |
| 4,588,055 | A | 5/1986 | Chen |
| 4,630,837 | A | 12/1986 | Kazmark |
| 4,846,493 | A | 7/1989 | Mason |
| 4,852,705 | A | 8/1989 | Cowan, Jr. |
| 4,890,414 | A | 1/1990 | Bridenthal et al. |
| 4,923,105 | A | 5/1990 | Snyder |
| D309,981 | S | 8/1990 | French et al. |
| D316,485 | S | 4/1991 | Seber |
| 5,035,523 | A | 7/1991 | Allinder |
| 5,042,193 | A | 8/1991 | Steiner |
| 5,048,649 | A | 9/1991 | Carpenter et al. |
| 5,108,119 | A | 4/1992 | Huang |
| 5,116,289 | A | 5/1992 | Pond et al. |
| D326,815 | S | 6/1992 | Meisner et al. |
| 5,147,019 | A | 9/1992 | Van Hooreweder et al. |
| 5,165,148 | A | 11/1992 | Fleischer et al. |
| 5,167,306 | A | 12/1992 | Carrigan, Jr. |
| 5,167,354 | A | 12/1992 | Cohanfard |
| D333,215 | S | 2/1993 | Brown |
| D333,487 | S | 2/1993 | Papp |
| 5,184,477 | A | 2/1993 | Brown et al. |
| 5,207,440 | A | 5/1993 | Liang |
| 5,209,327 | A | 5/1993 | Wright et al. |
| 5,228,609 | A | 7/1993 | Gregory |
| 5,228,706 | A | 7/1993 | Boville |
| 5,249,438 | A | 10/1993 | Rhaney et al. |
| 5,287,903 | A | 2/1994 | Ambasz |
| 5,295,742 | A | 3/1994 | Knutson |
| 5,310,079 | A | 5/1994 | Sandy et al. |
| 5,316,096 | A | 5/1994 | Good |
| D347,731 | S | 6/1994 | Hayakawa et al. |
| 5,323,886 | A | 6/1994 | Chen |
| 5,323,887 | A | 6/1994 | Scicluna et al. |
| 5,330,141 | A | 7/1994 | Kim |
| 5,358,082 | A | 10/1994 | Armstrong, IV |
| 5,368,143 | A | 11/1994 | Pond et al. |
| 5,377,795 | A | 1/1995 | Berman |
| 5,379,887 | A | 1/1995 | Conley, Jr. |
| D355,849 | S | 2/1995 | Trower et al. |
| 5,386,907 | A | 2/1995 | Kahl et al. |
| 5,394,965 | A | 3/1995 | Kho |
| 5,396,974 | A | 3/1995 | Pedlar |
| 5,429,287 | A | 7/1995 | Frano |
| 5,431,262 | A | 7/1995 | Rekuc et al. |
| 5,435,423 | A | 7/1995 | Rekuc et al. |
| 5,447,216 | A | 9/1995 | Freyvogel |
| 5,447,261 | A | 9/1995 | Mitomi et al. |
| 5,452,778 | A | 9/1995 | Wang |
| 5,469,944 | A | 11/1995 | Wang |
| 5,470,000 | A | 11/1995 | Muñoz |
| 5,474,162 | A | 12/1995 | Shyr et al. |
| 5,482,147 | A | 1/1996 | Wang |
| D368,159 | S | 3/1996 | Calmeise et al. |
| 5,498,010 | A | 3/1996 | Stube |
| 5,499,702 | A | 3/1996 | Wang |
| 5,501,308 | A | 3/1996 | King |
| 5,501,379 | A | 3/1996 | Muñoz |
| 5,513,066 | A | 4/1996 | Berman |
| 5,518,139 | A | 5/1996 | Trower et al. |
| D370,619 | S | 6/1996 | Hall et al. |
| 5,524,737 | A | 6/1996 | Wang |
| 5,524,920 | A | 6/1996 | Tsai |
| 5,528,453 | A | 6/1996 | Berman et al. |
| 5,529,230 | A | 6/1996 | Smith |
| 5,529,322 | A | 6/1996 | Barton |
| 5,542,510 | A | 8/1996 | Rekuc et al. |
| 5,553,692 | A | 9/1996 | Sheiman |
| D374,772 | S | 10/1996 | Hotaling et al. |
| 5,560,458 | A | 10/1996 | Franklin et al. |
| 5,560,459 | A | 10/1996 | Lin |
| 5,562,208 | A | 10/1996 | Hasler et al. |
| 5,564,538 | A | 10/1996 | Sadow |
| 5,564,805 | A | 10/1996 | Dickinson |
| 5,568,848 | A | 10/1996 | Liang |
| D375,834 | S | 11/1996 | Meisner et al. |
| 5,570,824 | A | 11/1996 | Lyon et al. |
| 5,575,391 | A | 11/1996 | Gerch |
| 5,579,877 | A | 12/1996 | Homayoon |
| 5,580,137 | A | 12/1996 | Doan et al. |
| 5,588,569 | A | 12/1996 | Mitomi et al. |
| D377,118 | S | 1/1997 | Carbone et al. |
| 5,593,009 | A | 1/1997 | King |
| 5,595,228 | A | 1/1997 | Meisner et al. |
| 5,605,263 | A | 2/1997 | Pursley et al. |
| D378,247 | S | 3/1997 | Meisner et al. |
| 5,609,278 | A | 3/1997 | Fresco |
| 5,620,212 | A | 4/1997 | Bourne et al. |
| 5,630,488 | A | 5/1997 | Chen |
| 5,639,003 | A | 6/1997 | Utzinger, III |
| 5,641,170 | A | 6/1997 | Helm |
| 5,645,146 | A | 7/1997 | Bieber et al. |
| 5,653,337 | A | 8/1997 | Cirigliano |
| 5,660,276 | A | 8/1997 | Winnard |
| 5,664,652 | A | 9/1997 | Shamah |
| 5,667,172 | A | 9/1997 | Kim |
| 5,671,832 | A | 9/1997 | London et al. |
| 5,672,145 | A | 9/1997 | Pollington et al. |
| D385,110 | S | 10/1997 | Yemini |
| 5,678,666 | A | 10/1997 | Shyr et al. |
| 5,685,402 | A | 11/1997 | Lin |
| D386,903 | S | 12/1997 | Curry et al. |
| 5,709,008 | A | 1/1998 | Dickinson |
| D390,358 | S | 2/1998 | Calmeise |
| 5,715,759 | A | 2/1998 | Lee |
| 5,732,987 | A | 3/1998 | Wright et al. |
| 5,755,311 | A | 5/1998 | Younessian et al. |
| 5,762,170 | A | 6/1998 | Shyr et al. |
| 5,762,411 | A | 6/1998 | Yemini |
| 5,788,032 | A | 8/1998 | Krulik |
| 5,788,260 | A | 8/1998 | Huang |
| 5,806,143 | A * | 9/1998 | Tsai ..... A45C 13/262 16/405 |

(56) References Cited

U.S. PATENT DOCUMENTS 5,810,132 A 9/1998 Chang
5,819,892 A 10/1998 Deliman et al.
5,833,039 A 11/1998 Kotkins, Jr.
5,833,095 A 11/1998 Russell et al.
5,836,497 A 11/1998 Pelish
D402,106 S 12/1998 Buckingham et al.
5,862,898 A 1/1999 Chang
D405,956 S 2/1999 Meisner et al.
5,865,281 A 2/1999 Wang
5,890,570 A 4/1999 Sadow
5,893,495 A 4/1999 Godshaw et al.
5,915,553 A 6/1999 Brown et al.
5,915,554 A 6/1999 Hung
5,924,533 A 7/1999 Cnockaert et al.
5,927,837 A 7/1999 Schmidt
5,934,425 A 8/1999 Sadow
5,941,437 A 8/1999 Okumura
5,943,936 A 8/1999 Deliman et al.
D414,038 S 9/1999 van Rhienen
5,967,270 A 10/1999 Shyr
5,971,101 A 10/1999 Taggart
5,971,119 A 10/1999 Chi
5,992,588 A 11/1999 Morszeck
5,997,116 A 12/1999 Schmidt
6,006,906 A 12/1999 Winnard
D418,977 S 1/2000 Streich
6,015,064 A 1/2000 Liu
6,038,747 A 3/2000 Hamilton et al.
6,050,374 A 4/2000 Johnston
6,062,357 A 5/2000 Bogert
6,073,766 A 6/2000 Winnard
6,073,944 A 6/2000 Moore
6,076,666 A 6/2000 Santa-Maria
6,079,527 A 6/2000 Kuo
6,081,695 A 6/2000 Wallace et al.
6,082,538 A 7/2000 Snider et al.
6,098,768 A 8/2000 Tsai
6,102,172 A 8/2000 Dercole
6,109,403 A 8/2000 Godshaw
6,129,254 A 10/2000 Yu
6,167,680 B1 1/2001 Horn
6,167,994 B1 1/2001 Kuo et al.
6,176,559 B1 1/2001 Tiramani et al.
6,179,185 B1 1/2001 Dancyger
D437,684 S 2/2001 Streich et al.
6,182,981 B1 2/2001 Kuo
6,186,295 B1 2/2001 Lin et al.
6,203,075 B1 3/2001 Wells, Jr. et al.
6,206,063 B1 3/2001 Lin
6,213,296 B1 4/2001 Streich et al.
6,223,391 B1 5/2001 Kuo
6,227,339 B1 5/2001 Bogert
6,230,887 B1 5/2001 Snider
6,244,485 B1 6/2001 Holland et al.
6,244,486 B1 6/2001 Holland et al.
D447,340 S 9/2001 Snider
D447,630 S 9/2001 Snider
D448,162 S 9/2001 Snider
6,289,554 B1 9/2001 Wang
D449,442 S 10/2001 Snider
D449,738 S 10/2001 Snider et al.
6,301,746 B1 10/2001 Myers et al.
6,305,514 B1 10/2001 Lin et al.
6,318,713 B1 11/2001 Levi
D451,275 S 12/2001 Snider et al.
D452,071 S 12/2001 Snider
6,328,320 B1 12/2001 Walski et al.
6,338,586 B1 1/2002 Kuo
6,339,863 B1 1/2002 Kuo
D453,624 S 2/2002 Itzkovitch
6,343,708 B1 2/2002 Riso
6,343,815 B1 2/2002 Poe
6,347,847 B1 2/2002 Tiramani et al.
6,357,080 B1 * 3/2002 Tsai ..... A45C 13/262 16/113.1
6,357,567 B1 3/2002 Tsai
D455,263 S 4/2002 Schoen et al.
6,367,603 B1 4/2002 Tiramani et al.
6,371,320 B2 4/2002 Sagol
6,371,346 B1 4/2002 Sharma
6,378,674 B1 * 4/2002 Lee ..... A45C 13/262 16/113.1
6,390,348 B1 5/2002 Godshaw et al.
D459,073 S 6/2002 Lee
6,405,864 B1 6/2002 Streich et al.
6,408,996 B1 6/2002 Lin
6,415,924 B1 7/2002 Lee
6,435,389 B1 8/2002 Sucher
D462,168 S 9/2002 Klemmensen et al.
6,443,274 B1 9/2002 Klamm
6,446,988 B1 9/2002 Kho
6,460,668 B1 10/2002 Godshaw et al.
6,471,019 B1 10/2002 Miller
D465,923 S 11/2002 Pangerc et al.
6,474,665 B1 11/2002 Fink et al.
6,478,463 B2 11/2002 Snider
6,484,362 B1 11/2002 Kuo
D467,070 S 12/2002 Snider et al.
6,502,882 B2 1/2003 Snider et al.
6,505,843 B1 1/2003 Williams
D470,659 S 2/2003 Story et al.
6,520,514 B2 2/2003 Clegg
D471,360 S 3/2003 Huang
6,527,309 B1 3/2003 Gaydos et al.
6,530,507 B2 3/2003 Oh
6,533,138 B2 3/2003 Chwen-Ru
D472,385 S 4/2003 Bauer
D472,774 S 4/2003 Pelstring et al.
6,550,651 B1 4/2003 Murdoch et al.
6,561,327 B1 5/2003 Godshaw
6,561,402 B2 5/2003 Holland et al.
6,571,998 B2 6/2003 Godshaw et al.
6,575,493 B1 6/2003 Lowenstein
6,578,708 B2 6/2003 Barnett
6,595,334 B1 7/2003 Saetia
6,609,271 B2 * 8/2003 Kuo ..... A45C 13/262 16/113.1
6,614,337 B1 9/2003 Winnard
6,619,448 B1 9/2003 Wang
6,622,856 B2 9/2003 Gallo et al.
D480,867 S 10/2003 Snider et al.
6,637,562 B2 10/2003 Oh
6,666,363 B2 12/2003 Godshaw et al.
6,675,965 B2 1/2004 Holland et al.
6,675,967 B2 1/2004 Huang
6,688,614 B2 2/2004 Hsu
6,692,011 B2 2/2004 Carlson et al.
6,695,142 B2 2/2004 Chen et al.
6,698,609 B2 3/2004 Pangerc et al.
6,722,524 B1 4/2004 Huang et al.
6,736,265 B2 5/2004 Kipper et al.
6,739,150 B2 5/2004 Mompo Garcia
6,742,684 B2 6/2004 Oh
6,755,302 B1 6/2004 Streich et al.
6,755,448 B2 6/2004 Jackson et al.
6,758,534 B2 7/2004 Lampugnani
6,761,366 B1 7/2004 Klemmensen et al.
6,789,670 B2 9/2004 Cooper et al.
6,820,878 B2 11/2004 Safari et al.
6,827,186 B1 * 12/2004 Hsie ..... A45C 13/262 16/113.1
6,840,359 B2 1/2005 Godshaw
6,860,059 B1 3/2005 Hoover
D505,548 S 5/2005 Yang
6,910,560 B2 6/2005 Dulin
6,915,902 B2 7/2005 Brouard
6,923,352 B2 8/2005 Oh
6,926,129 B2 8/2005 Hoberman
D509,656 S 9/2005 Pangerc et al.
6,938,740 B2 9/2005 Gandy
6,938,741 B2 9/2005 Hsien et al.
6,945,546 B2 9/2005 Guirlinger
6,948,724 B2 9/2005 Davis
6,955,381 B2 10/2005 Parker et al.

(56) References Cited

U.S. PATENT DOCUMENTS 6,976,566 B1 12/2005 Skriloff
6,978,890 B2 12/2005 Pangerc et al.
7,004,481 B1 2/2006 Stanish
D516,310 S 3/2006 Brunson et al.
D516,808 S 3/2006 Brunson et al.
D516,812 S 3/2006 Pangerc et al.
7,008,031 B2 3/2006 Doerflinger et al.
7,021,637 B2 4/2006 Snider et al.
D520,746 S 5/2006 Meyer et al.
7,036,641 B2 5/2006 Russo et al.
7,048,133 B2 5/2006 Pangerc et al.
7,066,311 B2 6/2006 O'Shea
7,073,694 B2 7/2006 King et al.
7,104,555 B1 9/2006 Davis
7,108,131 B2 9/2006 Dreher et al.
7,111,853 B2 9/2006 Tracewell et al.
7,117,991 B2 10/2006 Waring
7,121,407 B2 10/2006 Hurt et al.
7,143,912 B2 * 12/2006 Caneba ..... A45C 13/262 224/153
7,144,020 B2 12/2006 Huguet
7,147,089 B2 12/2006 Godshaw et al.
7,158,376 B2 1/2007 Richardson et al.
7,163,337 B2 1/2007 Penson
7,168,713 B2 1/2007 Udall et al.
7,201,243 B2 4/2007 Konstant
7,207,085 B1 * 4/2007 Chen ..... A45C 13/262 16/113.1
7,225,923 B2 6/2007 Hallee et al.
7,228,983 B2 6/2007 Pangerc et al.
7,237,673 B2 7/2007 Wikle et al.
7,237,688 B2 7/2007 Pangerc et al.
7,240,909 B2 7/2007 Robens
7,246,704 B2 7/2007 Brunson et al.
7,270,223 B2 9/2007 Miller
7,296,808 B2 11/2007 Huguet
7,316,309 B2 1/2008 Streich et al.
7,318,542 B2 1/2008 Godshaw et al.
7,322,470 B2 1/2008 Brunson
7,322,583 B2 1/2008 Kin et al.
7,326,428 B2 2/2008 Weir
7,331,454 B2 2/2008 Godshaw et al.
7,334,680 B2 2/2008 Cunningham et al.
D563,669 S 3/2008 Bosak et al.
7,357,250 B2 4/2008 Hagemann et al.
7,357,268 B2 4/2008 Yang
7,367,451 B2 5/2008 Pendergraph et al.
7,370,891 B1 5/2008 Schmitt et al.
7,374,183 B1 5/2008 Yen-Lung
7,387,304 B1 6/2008 Rich et al.
7,387,305 B2 6/2008 Vanderberg et al.
7,387,350 B2 6/2008 Killinger et al.
7,389,997 B2 6/2008 Johnson et al.
D572,479 S 7/2008 Buck et al.
D572,480 S 7/2008 Buck et al.
7,401,698 B2 7/2008 Dost et al.
7,401,700 B2 7/2008 Dost et al.
7,416,066 B2 8/2008 Chernoff
7,418,846 B2 9/2008 James et al.
7,438,084 B2 10/2008 Trettin et al.
7,438,308 B2 10/2008 Kim et al.
7,458,601 B2 12/2008 Miller et al.
7,461,730 B2 12/2008 Costa et al.
7,467,695 B2 12/2008 Gormick et al.
7,478,711 B2 1/2009 Liang
D588,811 S 3/2009 Wenchel et al.
7,500,547 B2 3/2009 Bettua et al.
7,503,439 B2 3/2009 O'Shea et al.
7,503,440 B2 3/2009 Gormick et al.
7,503,569 B2 3/2009 Duvigneau
7,506,736 B1 * 3/2009 Chen ..... A45C 13/262 16/113.1
D589,703 S 4/2009 Wenchel et al.
7,516,502 B1 4/2009 Larson et al.
7,540,364 B2 6/2009 Sanderson
7,549,520 B1 * 6/2009 Chen ..... A45C 13/262 16/113.1
7,552,560 B2 6/2009 Hoover
7,552,950 B2 6/2009 Scheffy et al.
7,571,915 B1 8/2009 Simmons
D599,112 S 9/2009 Wenchel et al.
D600,015 S 9/2009 Wenchel et al.
D600,912 S 9/2009 Brunner
7,581,736 B1 9/2009 Garza, Jr.
7,591,627 B2 9/2009 Westover
7,594,569 B2 9/2009 Bass et al.
D601,797 S 10/2009 Wenchel et al.
7,597,341 B2 10/2009 Russo et al.
7,600,618 B2 10/2009 Fenton et al.
7,600,640 B2 10/2009 Hallee et al.
D605,403 S 12/2009 Santamarina et al.
7,631,380 B1 12/2009 Larson
D608,094 S 1/2010 Concari et al.
D609,911 S 2/2010 Twig
D609,913 S 2/2010 Landau
7,661,530 B1 2/2010 Hewitt
7,661,683 B2 2/2010 Fernandez
D616,200 S 5/2010 Riedel et al.
D618,911 S 7/2010 Brunner
D621,153 S 8/2010 Parsley et al.
D621,610 S 8/2010 Parsley et al.
7,780,051 B2 8/2010 Godshaw et al.
D624,317 S 9/2010 Wenchel et al.
D625,515 S 10/2010 Parsley et al.
D625,915 S 10/2010 Parsley et al.
D627,968 S 11/2010 Brunner
7,823,991 B2 11/2010 Purdy
7,837,053 B2 11/2010 Arnett et al.
7,837,206 B1 11/2010 Lee
D629,607 S 12/2010 Sabbag et al.
7,845,653 B2 12/2010 Katz
7,850,020 B2 12/2010 Konsant
7,854,321 B2 12/2010 Twig et al.
D630,435 S 1/2011 Brunner
D630,851 S 1/2011 Landau et al.
7,874,328 B2 1/2011 Dancyger
7,883,096 B2 2/2011 Katz et al.
D635,769 S 4/2011 Sosnovsky
D636,996 S 5/2011 Kokawa et al.
D637,812 S 5/2011 Horiyama et al.
7,938,412 B2 5/2011 Katz
7,946,609 B2 5/2011 Johnson et al.
D639,554 S 6/2011 Sosnovsky et al.
D641,552 S 7/2011 Sosnovsky
7,984,820 B2 7/2011 Dancyger
7,997,591 B2 8/2011 Arthur
D647,301 S 10/2011 Sosnovsky
8,037,983 B2 10/2011 Leung
D648,532 S 11/2011 Sosnovsky
D648,533 S 11/2011 Sosnovsky
D649,350 S 11/2011 Shitrit
8,056,919 B1 11/2011 Huston et al.
8,056,943 B2 11/2011 Scheffy et al.
8,061,536 B2 11/2011 Lin et al.
D649,783 S 12/2011 Brunner
8,087,513 B2 1/2012 Kriesel
8,123,007 B2 2/2012 Murdoch et al.
8,123,068 B2 2/2012 Sturrock
8,132,289 B2 3/2012 Hahn
8,132,819 B2 3/2012 Landau et al.
8,152,037 B2 4/2012 Sabbag
D661,858 S 6/2012 Lifshitz et al.
D661,903 S 6/2012 Kokawa et al.
8,191,910 B2 6/2012 Landau et al.
D664,354 S 7/2012 Crevling, Jr. et al.
8,210,387 B2 7/2012 Twig et al.
8,256,591 B2 9/2012 Majeau
8,262,106 B1 9/2012 Suszynsky
8,267,230 B2 9/2012 Johnson et al.
8,267,245 B2 9/2012 Kotula et al.
8,267,247 B1 9/2012 Horiyama
8,272,628 B2 9/2012 Winnard
D668,867 S 10/2012 Yamamot
D668,868 S 10/2012 Lehovetzki

(56) References Cited

U.S. PATENT DOCUMENTS

D668,869 S 10/2012 Yamamoto et al.
8,282,113 B2 10/2012 Veal et al.
D670,500 S 11/2012 Sosnovsky
D672,555 S 12/2012 Shitrit
8,327,576 B2 12/2012 Sellers
8,328,247 B2 12/2012 Tonelli
8,328,530 B2 12/2012 Fronzoni
D673,774 S 1/2013 Neuhaus et al.
8,342,543 B2 1/2013 Fernandez
8,365,886 B2 2/2013 Mehta
8,376,177 B2 2/2013 Castner et al.
8,434,617 B1 5/2013 Wang
8,439,174 B1 5/2013 Miranda
8,469,195 B2 6/2013 Gosselink et al.
8,490,765 B2 7/2013 Lee et al.
8,505,729 B2 8/2013 Sosnovsky et al.
8,517,155 B2 8/2013 Tong
8,517,400 B2 8/2013 Kim
8,534,434 B2 9/2013 Crull
8,567,796 B2 10/2013 Bar-Erez et al.
D692,658 S 11/2013 Bensman et al.
D693,121 S 11/2013 Bensman et al.
8,657,307 B2 2/2014 Lifshitz et al.
8,662,268 B2 3/2014 Keir
D701,696 S 4/2014 Shitrit et al.
8,695,770 B2 4/2014 Santy
8,708,351 B2 4/2014 Kinskey et al.
8,752,683 B2 6/2014 Scicluna
8,844,689 B2 9/2014 Murdoch et al.
8,851,282 B2 10/2014 Brunner
8,869,960 B2 10/2014 Mangano
8,888,111 B2 11/2014 Udall et al.
8,919,896 B1 12/2014 Shewchuck
8,936,140 B2 1/2015 Herold
8,936,258 B2 1/2015 Bar-Erez et al.
8,960,959 B2 2/2015 Chen et al.
8,979,073 B2 3/2015 Lykins et al.
8,979,100 B2 3/2015 Bensman et al.
9,060,577 B2 6/2015 Farrelly et al.
9,066,565 B2 6/2015 Farrelly
9,067,614 B2 6/2015 Vanderberg et al.
9,095,193 B1 8/2015 Al-Hashemi et al.
9,161,600 B1 * 10/2015 Liu ..... A45C 13/262
D744,750 S 12/2015 Sabbag et al.
9,260,129 B2 2/2016 Thompson
D750,890 S 3/2016 Quehl
9,295,313 B2 3/2016 Kinskey et al.
2001/0022257 A1 9/2001 Sadow
2002/0008125 A1 1/2002 Caputi
2002/0014507 A1 2/2002 Snider et al.
2002/0017752 A1 2/2002 Levi
2002/0043534 A1 4/2002 Uke
2002/0074332 A1 6/2002 Sagol
2002/0084159 A1 7/2002 Hamlin
2002/0125160 A1 9/2002 Itzkovitch
2002/0162716 A1 11/2002 Fabritz
2002/0163284 A1 11/2002 Levy et al.
2003/0034636 A1 2/2003 Ng
2003/0042091 A1 3/2003 Oh
2003/0042093 A1 3/2003 Godshaw et al.
2003/0075468 A1 4/2003 Story et al.
2003/0132080 A1 7/2003 Ddababneh
2003/0151218 A1 8/2003 Swaffield
2004/0004332 A1 1/2004 Tsai
2004/0026199 A1 2/2004 Chen
2004/0026294 A1 2/2004 Platte, III
2004/0036240 A1 2/2004 Chen
2004/0108179 A1 6/2004 Scicluna et al.
2004/0112777 A1 6/2004 Huang
2004/0144606 A1 7/2004 Han
2004/0154889 A1 8/2004 Gifford et al.
2004/0163910 A1 8/2004 Lee
2004/0188201 A1 9/2004 Chuo
2004/0188205 A1 9/2004 Badaan
2004/0195791 A1 10/2004 Brookes-Inglis
2004/0206431 A1 10/2004 Metzig et al.
2004/0245735 A1 12/2004 Pins
2005/0023096 A1 2/2005 Tiramani
2005/0056511 A1 3/2005 Hsieh
2005/0067245 A1 * 3/2005 Tsai ..... A45C 13/262
190/115
2005/0109650 A1 5/2005 Huang
2005/0121275 A1 6/2005 Platte, III
2005/0121868 A1 6/2005 Hartman et al.
2005/0194756 A1 9/2005 Farley
2005/0224305 A1 10/2005 Davis
2005/0279123 A1 12/2005 Maldonado et al.
2006/0017293 A1 1/2006 Tonelli
2006/0124505 A1 6/2006 Hanson
2006/0144732 A1 7/2006 Kaplan et al.
2006/0151967 A1 7/2006 Conway et al.
2006/0196744 A1 9/2006 Greiner
2006/0201834 A1 9/2006 Lutz
2006/0213029 A1 * 9/2006 Lu ..... A45C 13/262
16/113.1
2006/0213735 A1 9/2006 Weinstein et al.
2006/0225981 A1 * 10/2006 Lin ..... A45C 13/262
190/115
2007/0045370 A1 3/2007 Hsieh
2007/0045974 A1 3/2007 Young
2007/0051765 A1 3/2007 Hsieh
2007/0074941 A1 4/2007 Liang
2007/0137960 A1 6/2007 Redzisz
2007/0164064 A1 7/2007 Nathan
2007/0170671 A1 7/2007 Safari et al.
2007/0194543 A1 8/2007 Duvigneau
2007/0200309 A1 8/2007 Coppedge
2007/0215425 A1 9/2007 Slater
2007/0241113 A1 10/2007 Williams
2007/0267371 A1 11/2007 Farley
2007/0290466 A1 12/2007 Lenz
2008/0017463 A1 1/2008 Huang
2008/0017537 A1 1/2008 Inskeep et al.
2008/0035508 A1 2/2008 Streich et al.
2008/0035510 A1 2/2008 Brunson
2008/0067206 A1 3/2008 Kuhn
2008/0135364 A1 6/2008 Chang et al.
2008/0135366 A1 6/2008 Katz et al.
2008/0136130 A1 6/2008 Washington
2008/0152944 A1 6/2008 Bonini et al.
2008/0164842 A1 7/2008 Bergner
2008/0169739 A1 7/2008 Goldenberg
2008/0217130 A1 9/2008 Louis
2008/0230416 A1 9/2008 Brouard
2009/0014974 A1 1/2009 VanVorst et al.
2009/0080809 A1 3/2009 Pham et al.
2009/0139813 A1 6/2009 Francis
2009/0166141 A1 7/2009 Davis et al.
2009/0211932 A1 8/2009 Schnitt et al.
2009/0212536 A1 8/2009 Tadeo
2009/0236810 A1 9/2009 Anderson
2009/0250365 A1 10/2009 Goto et al.
2009/0301833 A1 12/2009 Hymas
2010/0000805 A1 1/2010 Pan
2010/0012538 A1 1/2010 Brunner
2010/0012655 A1 1/2010 Dathy
2010/0033325 A1 2/2010 Vilkomirski et al.
2010/0101908 A1 4/2010 Chun
2010/0108451 A1 5/2010 Pain et al.
2010/0108452 A1 5/2010 Williams et al.
2010/0175960 A1 7/2010 Moskowitz et al.
2010/0224527 A1 9/2010 Huang
2010/0258465 A1 10/2010 Gomas
2010/0320245 A1 12/2010 Vilkomirski et al.
2011/0067967 A1 3/2011 Herrera et al.
2011/0084075 A1 4/2011 Arnett et al.
2011/0094910 A1 4/2011 Fleury et al.
2011/0121695 A1 5/2011 Purdy
2011/0132046 A1 6/2011 Tonelli
2011/0155526 A1 6/2011 Cheng
2011/0174648 A1 7/2011 Huang et al.
2011/0214957 A1 9/2011 Barnard et al.
2011/0268374 A1 11/2011 Hotta et al.
2012/0018330 A1 1/2012 Kato et al.

(56) References Cited

U.S. PATENT DOCUMENTS

| | | | |
|---|---|---|---|
| 2012/0138403 | A1 | 6/2012 | Tong |
| 2012/0152944 | A1 | 6/2012 | Vilkomirski et al. |
| 2012/0160626 | A1 | 6/2012 | Yang |
| 2012/0206907 | A1 | 8/2012 | Seidel |
| 2012/0210596 | A1 | 8/2012 | Lebel |
| 2012/0257379 | A1 | 10/2012 | Herr et al. |
| 2012/0267374 | A1 | 10/2012 | Kotula et al. |
| 2012/0292213 | A1 | 11/2012 | Brunner |
| 2012/0312708 | A1 | 12/2012 | Roehm et al. |
| 2012/0317933 | A1 | 12/2012 | Crull |
| 2012/0318792 | A1 | 12/2012 | Larson et al. |
| 2012/0326406 | A1 | 12/2012 | Lifshitz et al. |
| 2012/0326669 | A1 | 12/2012 | Horiyama et al. |
| 2013/0007979 | A1 | 1/2013 | Wolfe et al. |
| 2013/0008753 | A1 | 1/2013 | Moon |
| 2013/0099648 | A1 | 4/2013 | Moore |
| 2013/0161143 | A1 | 6/2013 | Kinskey et al. |
| 2013/0186795 | A1 | 7/2013 | Borrelli |
| 2013/0233660 | A1 | 9/2013 | Bettua et al. |
| 2013/0240314 | A1 | 9/2013 | Pitchforth |
| 2013/0284553 | A1 | 10/2013 | Daniels |
| 2013/0292221 | A1 | 11/2013 | Ryan et al. |
| 2013/0327608 | A1 | 12/2013 | Murdoch et al. |
| 2014/0021232 | A1 | 1/2014 | Lazarevich et al. |
| 2014/0027227 | A1 | 1/2014 | Stern |
| 2014/0102928 | A1 | 4/2014 | Sabbag et al. |
| 2014/0166414 | A1 | 6/2014 | Moore |
| 2014/0166516 | A1 | 6/2014 | Martinez et al. |
| 2014/0197059 | A1 | 7/2014 | Evans et al. |
| 2014/0311844 | A1 | 10/2014 | Meersschaert et al. |
| 2014/0326562 | A1 | 11/2014 | Pickens et al. |
| 2014/0353104 | A1 | 12/2014 | Sheikh et al. |
| 2015/0047941 | A1 | 2/2015 | Wax |
| 2015/0060221 | A1 | 3/2015 | Bourette |
| 2015/0102573 | A1 | 4/2015 | Hillaert et al. |
| 2015/0107949 | A1 | 4/2015 | McDonald et al. |
| 2015/0129384 | A1 | 5/2015 | Mertens et al. |
| 2015/0130148 | A1 | 5/2015 | Meersschaert et al. |
| 2015/0136554 | A1 | 5/2015 | Herold |
| 2015/0150348 | A1 | 6/2015 | Wax |
| 2015/0173475 | A1 | 6/2015 | Dermody |
| 2015/0208774 | A1 | 7/2015 | Leimenstoll |
| 2016/0023349 | A1 | 1/2016 | Hoppe et al. |

FOREIGN PATENT DOCUMENTS

| | | |
|---|---|---|
| EP | 0517803 | 10/1996 |
| EP | 0780068 | 6/1997 |
| EP | 0686008 | 4/2001 |
| EP | 0591484 | 11/2001 |
| EP | 0874564 | 3/2002 |
| EP | 0717705 | 4/2003 |
| EP | 1259137 | 5/2003 |
| EP | 1107674 | 10/2003 |
| EP | 1475008 | 11/2004 |
| EP | 1340598 | 1/2006 |
| EP | 1332693 | 3/2007 |
| EP | 1395140 | 8/2007 |
| EP | 1724069 | 3/2009 |
| EP | 2407047 | 1/2012 |
| EP | 2266866 | 3/2012 |
| EP | 2502518 | 9/2012 |
| EP | 2024218 | 10/2012 |
| EP | 2522248 | 11/2012 |
| EP | 2561772 | 2/2013 |
| EP | 2051602 | 5/2013 |
| EP | 2596920 | 5/2013 |
| EP | 2710916 | 3/2014 |
| EP | 1853503 | 4/2014 |
| EP | 2730189 | 5/2014 |
| EP | 2594152 | 7/2014 |
| EP | 1852031 | 9/2014 |
| EP | 2537641 | 3/2015 |
| EP | 2862473 | 4/2015 |
| EP | 2873341 | 5/2015 |
| EP | 2873342 | 5/2015 |
| FR | 2657915 | 8/1991 |
| FR | 2903364 | 1/2008 |
| GB | 2436486 | 9/2007 |
| GB | 2443944 | 5/2008 |
| GB | 2443945 | 5/2008 |
| GB | 2459444 | 10/2009 |
| WO | WO 95/19119 | 7/1995 |
| WO | WO 95/22266 | 8/1995 |
| WO | WO 96/31930 | 10/1996 |
| WO | WO 02/37999 | 5/2002 |
| WO | WO 02/052975 | 7/2002 |
| WO | WO 03/063637 | 8/2003 |
| WO | WO 03/096838 | 11/2003 |
| WO | WO 2004/045329 | 6/2004 |
| WO | WO 2004/054399 | 7/2004 |
| WO | WO 2004/088163 | 10/2004 |
| WO | WO 2005/011429 | 2/2005 |
| WO | WO 2006/007266 | 1/2006 |
| WO | WO 2006/066644 | 6/2006 |
| WO | WO 2006/102585 | 9/2006 |
| WO | WO 2009/021146 | 2/2009 |
| WO | WO 2009/088853 | 7/2009 |
| WO | WO 2009/124302 | 10/2009 |
| WO | WO 2010/033133 | 3/2010 |
| WO | WO 2011/089376 | 7/2011 |
| WO | WO 2012/056030 | 5/2012 |
| WO | WO 2012/068075 | 5/2012 |
| WO | WO 2012/113056 | 8/2012 |
| WO | WO 2012/126949 | 9/2012 |
| WO | WO 2013/142452 | 9/2013 |
| WO | WO 2014125484 | 8/2014 |
| WO | WO 2014/177863 | 11/2014 |
| WO | WO 2015/049121 | 4/2015 |
| WO | WO 2015/110667 | 7/2015 |

OTHER PUBLICATIONS

Barska, "Barska Loaded Gear HD-400 Watertight Dry Box" website available as early as Mar. 13, 2013.

JR Shooting Sports, "Genuine Browning Shooting Accessories Utility Cases" website available as early as Aug. 20, 2003.

* cited by examiner

HANDLE ASSEMBLY FOR A CASE

CROSS-REFERENCE TO RELATED APPLICATION

This application claims priority to co-pending U.S. Provisional Patent Application No. 62/259,859, filed on Nov. 25, 2015, the entire contents of which is hereby incorporated by reference.

FIELD

The present invention relates to mobile (e.g., wheeled) devices and, more particularly, to a handle assembly for such devices.

SUMMARY

Tool storage devices are often used to transport tools and accessories between and around worksites. As such, the devices may include wheels and a telescoping handle assembly to allow for convenient transportation of the tool storage devices. However, durability is a factor because the devices may be used in various terrain and weather conditions on the worksite. Due to these conditions and the generally rugged use, the devices sustain various shocks and impacts that are transmitted from the device (e.g., the wheels) through the telescoping handle assembly. These impacts and shocks can lead to early failure of the mechanism that secures the telescoping handle assembly in an extended position.

In one independent aspect, a telescoping handle assembly for a mobile device, such as a wheeled device, a storage device, etc. may be provided. The handle assembly may generally include a first handle section; a second handle section telescopingly arranged relative to the first handle section; and a latch assembly fixed to one of the first handle section and the second handle section and selectively engageable with the other of the first handle section and the second handle section. The latch assembly may include a latch body positioned between the first handle section and the second handle section, and a shock-absorbing mount positioned between the latch body and the one of the first handle section and the second handle section.

In another independent aspect, a wheeled mobile device may generally include a frame; a wheel assembly supporting the frame; and a telescoping handle assembly including a first handle section, a second handle section telescopingly arranged relative to the first handle section, and a latch assembly fixed to one of the first handle section and the second handle section and selectively engageable with the other of the first handle section and the second handle section. The latch assembly may include a latch body positioned between the first handle section and the second handle section, and a shock-absorbing mount positioned between the latch body and the one of the first handle section and the second handle section.

In yet another independent aspect, a method of assembling a telescoping handle assembly for a mobile device may be provided. The method may generally include fixing a latch body of a latch assembly to one of a first handle section and a second handle section; positioning a shock-absorbing mount between the latch body and the one of the first handle section and the second handle section; and inserting the one of the first handle section and the second handle section into the other of the first handle section and the second handle section in a telescoping arrangement with the latch assembly positioned in the other of the first handle section and the second handle section.

Other independent features and independent aspects of the invention will become apparent by consideration of the following detailed description, claims and accompanying drawings.

DETAILED DESCRIPTION

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways. Also, it is to be understood that the phraseology and terminology used herein is for the purpose of description and should not be regarded as limiting.

Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof.

Figure 1:
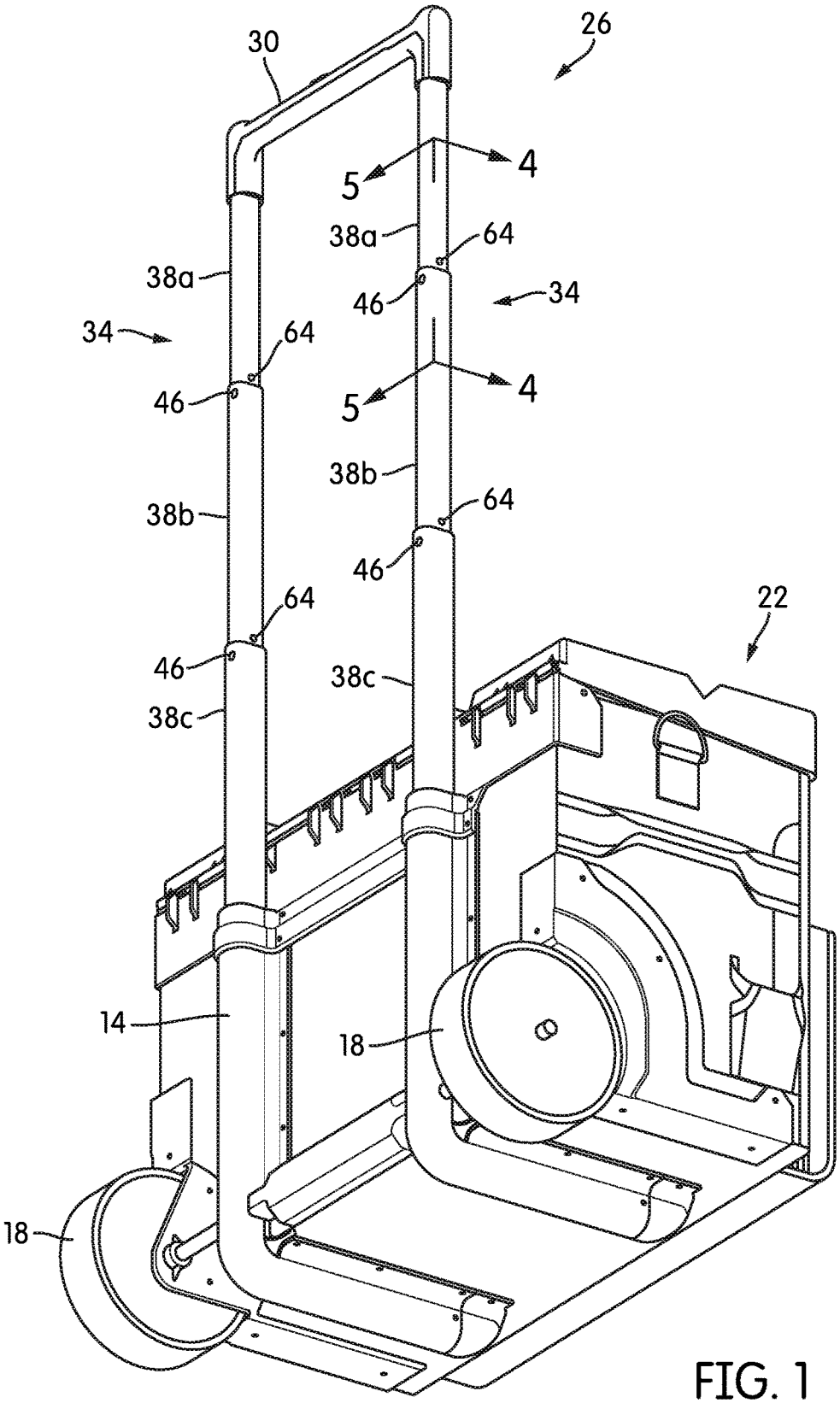
FIG. 1 is a perspective view of a mobile device, such as a wheeled storage device (e.g., a portable rolling tool bag).

FIG. 1 illustrates a mobile device 10, such as a portable rolling tool bag, movable between and around various locations (e.g., work sites, construction sites, garages, etc.). Exemplary devices are shown and described in U.S. Patent Application Publication No. 2016/0023349, filed Jul. 17, 2015, the entire contents of which is hereby incorporated by reference. In other constructions (not shown), the device 10 may include a tool box, a storage device, a suitcase, a trolley, a dolly, a hand truck, a cart, a wheel barrow, a stroller, a wheel chair, a bed, a table, etc.

The device 10 generally includes a frame 14 supported by one or more wheels 18. As a tool bag, the illustrated device 10 also includes a body 22 defining a storage compartment (not shown), capable of supporting and storing tools, accessories, materials, etc., in an organized manner. A handle assembly 26 is connected to the frame 14 and facilitates maneuvering of the device 10.

The handle assembly 26 includes a handle member 30 connected to an end of one or more support arms 34 (two in the illustrated construction) adjustably supported by the frame 14. Each support arm 34 includes a number of telescoping arm sections 38*a*, 38*b* . . . 38*n* (three in the illustrated construction). The arm sections 38*a*-38*c* are adjustable between an extended position (see FIGS. 1-2) and a retracted position (not shown) to adjust the position of the handle member 30 relative to the frame 14 and the body 22.

Each arm section 38 is an elongated hollow member with a substantially uniform cross-section extending along its length. Each outer arm section (e.g., the arm section 38*b*) has a cross-section sized to slidingly receive an associated inner arm section (e.g., the arm section 38*a*) having a relatively smaller concentric cross-section. In the illustrated embodiment, each arm section 38 has a generally rectangular cross-section defined by a pair of short walls 47 and a pair of long walls 48. In other embodiments (not shown), the arm sections 38 may have any shape cross-section with corresponding walls.

Figure 2:
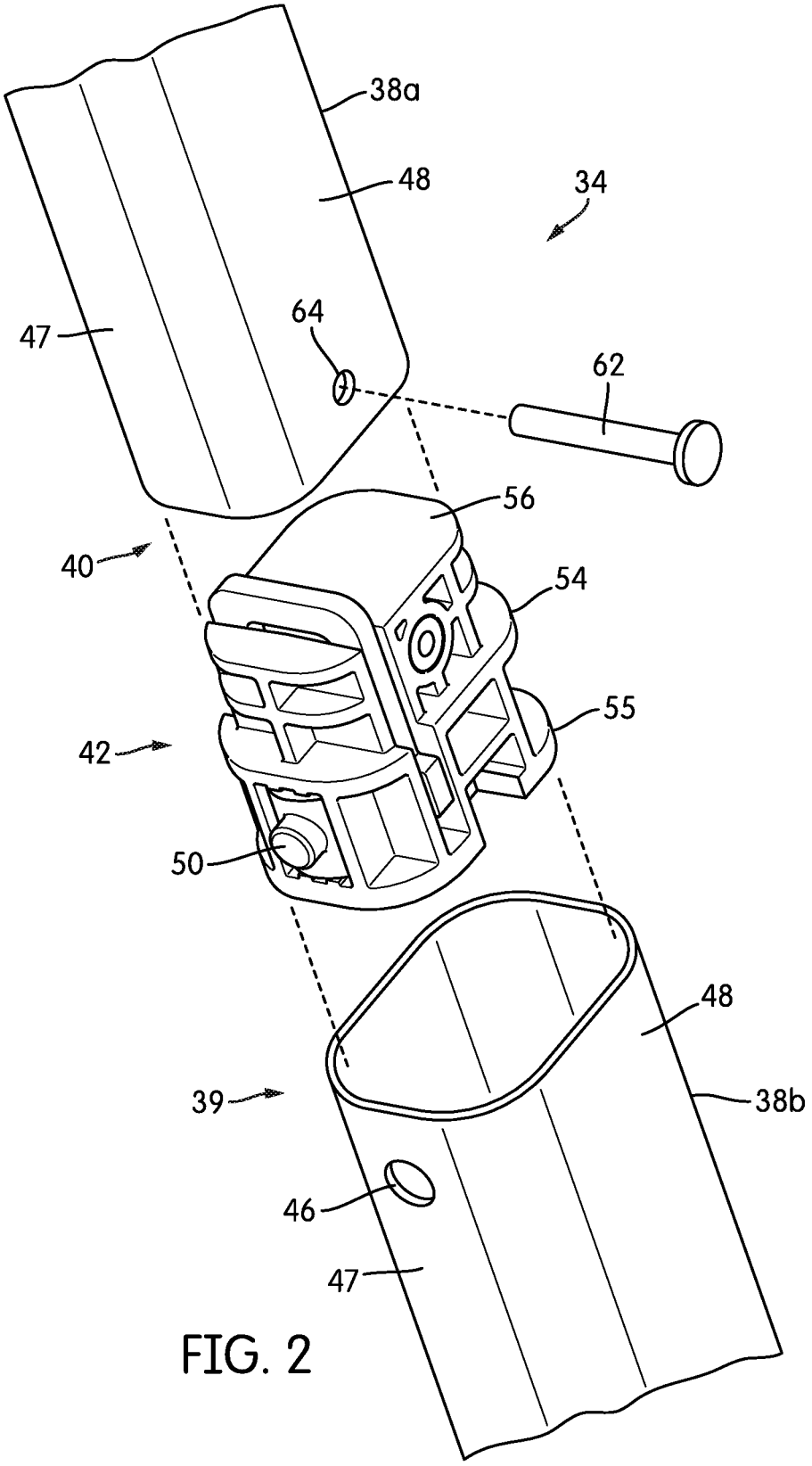
FIG. 2 is an enlarged exploded view of a handle assembly for the device shown in FIG. 1.

With reference to FIGS. 1-2, a latch assembly 42 is provided between adjacent arm sections 38 to selectively and releasably hold the arm sections 38 in the extended position. In the illustrated construction, each outer arm section (e.g., the arm section 38*b*) defines a recess (e.g., an opening 46) proximate its upper end 39, and each inner arm section (e.g., the arm section 38*a*) supports a projection 50 proximate its lower end 40. Each projection 50 is selectively engageable in an associated opening 46 to hold the adjacent arm sections (e.g., the arm sections 38*a*, 38*b*) in a selected relative position. In the illustrated embodiment, the opening 46 arranged to receive the projection 50 is defined in one of the short walls 47.

Figure 3:
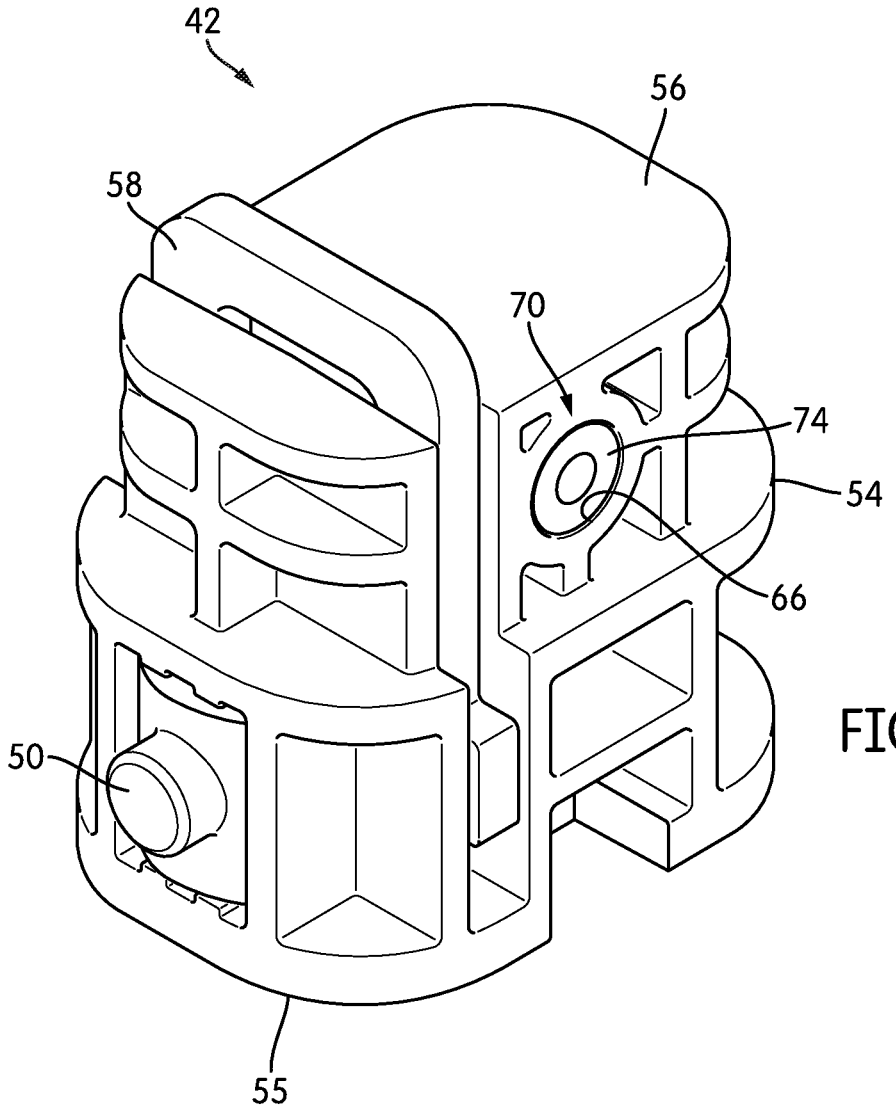
FIG. 3 is a perspective view of a latch assembly for the handle assembly shown in FIG. 2.

Each projection 50 (see FIG. 3) is movably supported on a lower portion 55 of a latch body 54. The lower portion 55 of the latch body 54 is sized to be slidingly received in the outer arm section 38 (e.g., the arm section 38*b*) and is too large to be received in the inner arm section 38 (e.g., the arm section 38*a*). An actuating member 58 is operable to move the projection 50 relative to the body 54 between a projected, latching position (see FIG. 3) and a retracted, release position (see FIG. 5). An actuator (not shown) is operable by the user to retract and disengage each projection 50 from its associated recess 46 so that the arm sections 38 can be retracted and the handle member 30 lowered.

Figure 4:
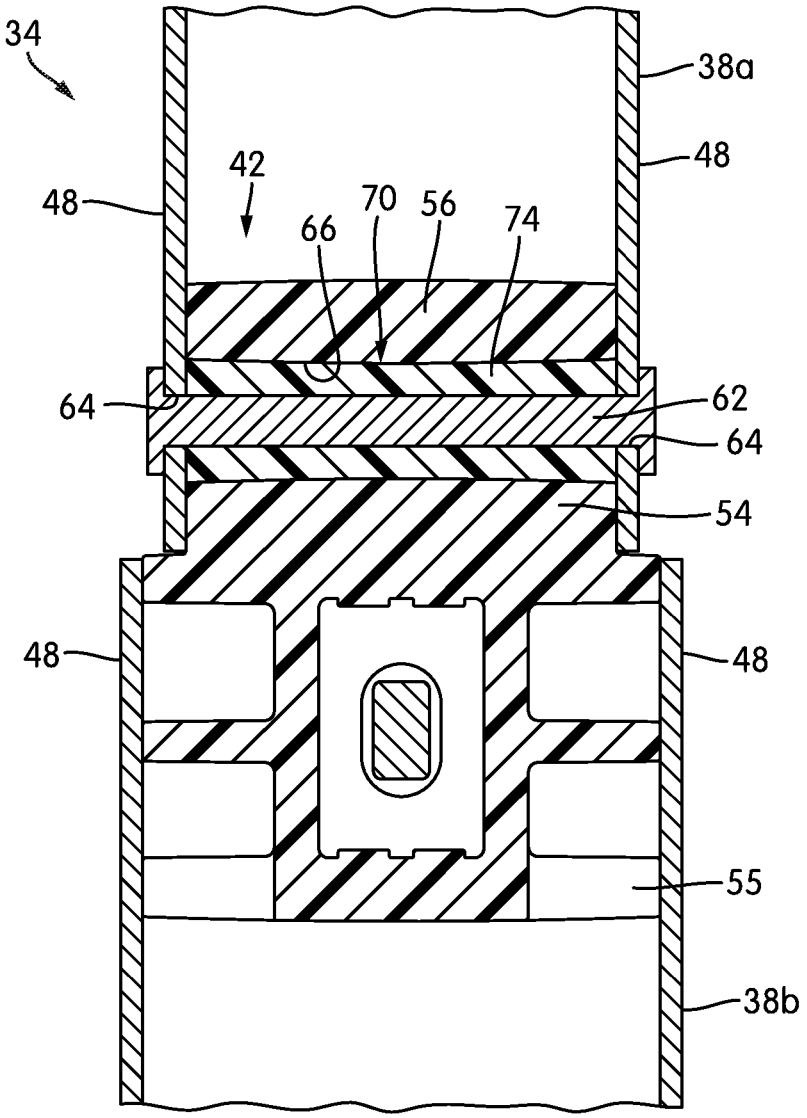
FIG. 4 is an enlarged cross-sectional view of the handle assembly of FIG. 2 taken generally along line 4-4 in FIG. 1.

The body 54 is fixed to the arm section (e.g., the arm section 38*a*), for example, by a rivet 62 (FIGS. 2 and 4), or a similar fastener, such as a pin, etc. In the illustrated construction, the rivet 62 extends through a pair of openings 64 defined in the long walls 48 of the arm section 38 adjacent the lower end 40 of the arm section 38 and an opening 66 in an upper portion 56 of the body 54 aligned with the openings 64 (as shown in FIG. 4). In the illustrated embodiment, one end of the rivet 62 has a pre-formed head and the other end of the rivet 62 is deformed to secure the rivet 62 from being axially removed from the opening 66 in the body 54.

Figure 5:
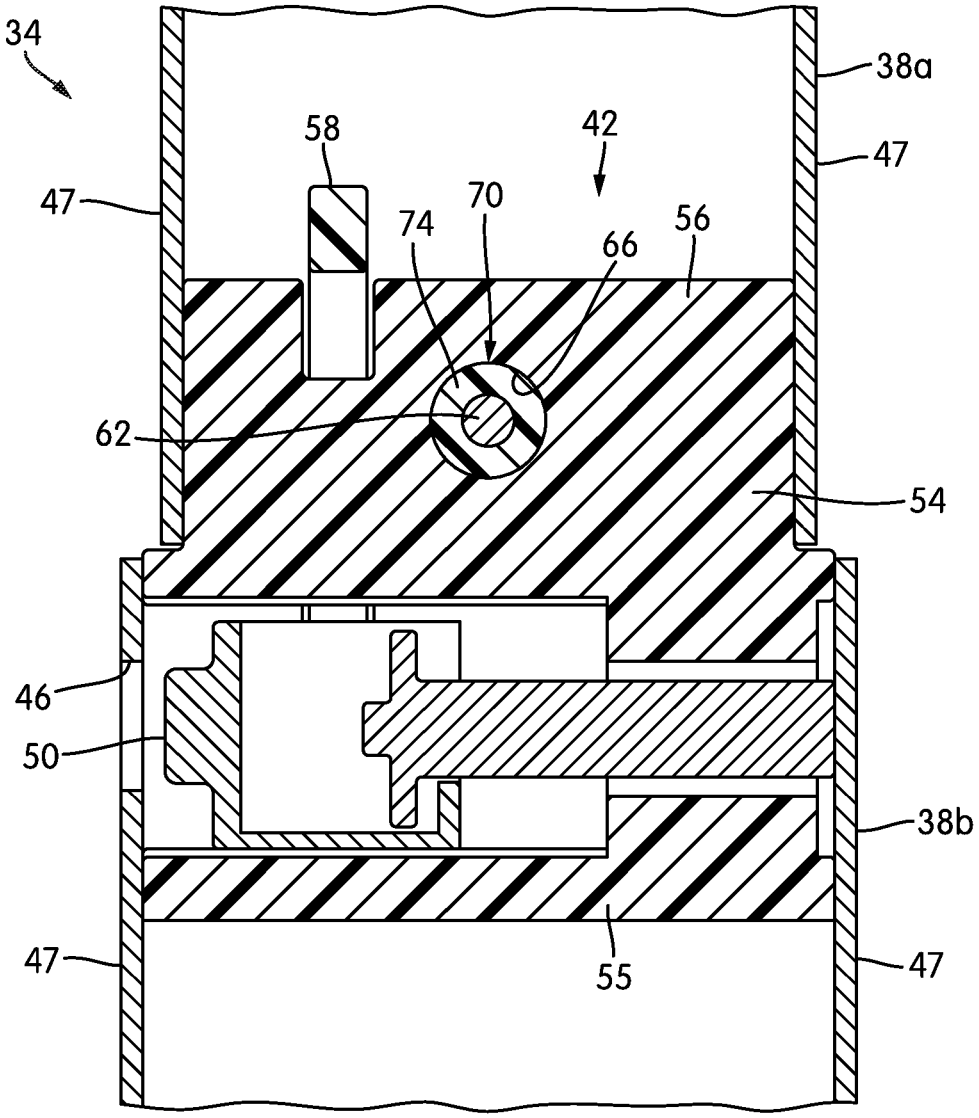
FIG. 5 is an enlarged cross-sectional view of the handle assembly of FIG. 2 taken generally along line 5-5 in FIG. 1.

The upper portion 56 of the body 54 is sized to be received in the lower end 40 of the inner arm section 38 (e.g., the arm section 38*a*), as shown in FIGS. 4-5. The lower portion 55 of the body 54 inhibits insertion of the upper portion 56 of the body 54 into the arm section 38 to a position in which the openings 64 in the long walls 48 do not align with the opening 66 in the body 54.

A similar handle assembly including a latch assembly is illustrated and described in U.S. Pat. No. 6,339,863, issued Jan. 22, 2002, and in U.S. Pat. No. 6,619,448, issued Sep. 16, 2003, the entire contents of both of which are hereby incorporated by reference.

Figure 6:
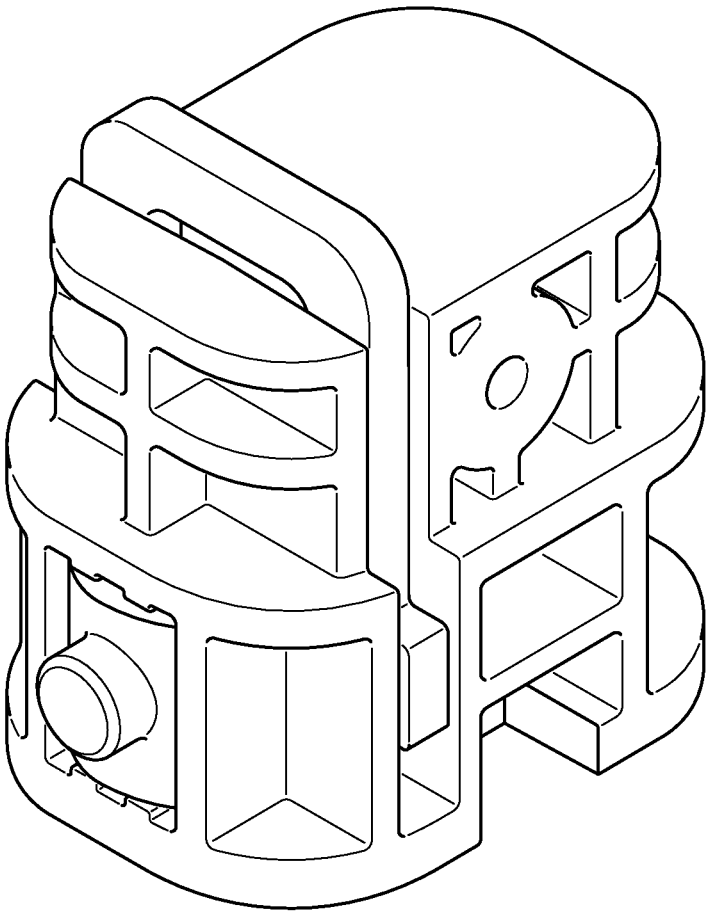
FIG. 6 is a perspective view of a prior art latch assembly.

In existing handle assemblies, a failure mode is a fracture around the rivet which causes the handle assembly to fail at 17 to 22 miles in a fatigue cyclic loading "life test". Such failure is likely to occur even with improved materials, geometry of an existing latch assembly (see FIG. 6).

Figure 3A:
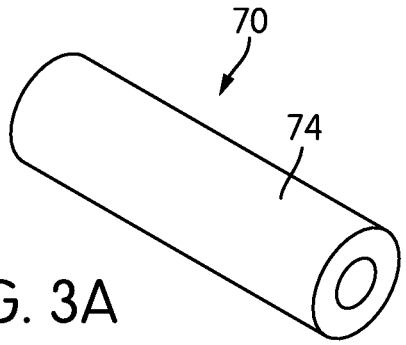
FIG. 3A is a perspective view of a bushing of the latch assembly shown in FIG. 3

As shown in FIGS. 2-5, the illustrated latch assembly 42 incorporates a shock-absorbing mount 70 (FIG. 3A) operable to absorb, dampen, limit, reduce, etc. a shock or impact between the frame 14 and the handle member 30 (e.g., between the body 54 and the walls 47, 48 of the adjacent arm section 38). The mount 70 may increase or contribute to an increase in the life, strength, durability, etc. of the handle assembly 26 to, for example, at least 30 miles or more in the fatigue cyclic loading "life test".

In the illustrated construction, the mount 70 includes a bushing 74 received in the opening 66 and is positioned between the body 54 and the rivet 62. The bushing 74 is formed of shock-absorbing material, such as, for example, urethane (e.g., thermoplastic polyurethane (TPU)), soft plastic, rubber, etc. The material, material characteristics, structure, etc. of the bushing 74 can be adjusted based on, for example, the desired shock-absorbing characteristics.

As illustrated, the bushing 74 is formed as a discrete or separate part and is inserted into the opening 66. In other constructions (not shown), the bushing 74 may be formed with the body 54, for example, in a multi-shot molding process for the body 54. After the bushing 74 is assembled with the body 54, the rivet 62 is inserted.

In operation with the illustrated mount 70, an impact or shock on the device 10 (e.g., on the wheels 18 as the device 10 is rolled across an uneven surface) is transmitted through the frame 14 to the outer arm section (e.g., the arm section 38*b*), through the walls 47, 48 of the arm section 38*b* to the body 54. The shock is absorbed or dampened by the bushing 74 before reaching the rivet 62 and, through the rivet 62, the inner arm section (e.g., the arm section 38*a*) and the handle member 30. An impact or shock on the handle member 30 is likewise absorbed or dampened by the bushing 74 before reaching the walls 47, 48 of the outer arm section 38*b*. Providing a mount 70 between each of the adjacent arm sections 38 sequentially reduces the magnitude of the impact or shock as it passes through each of the mounts 70.

In other constructions (not shown), in addition to or as an alternative to the illustrated mount 70, a shock-absorbing mount may be provided at one or more other locations between components in the force-transmitting path between the frame 14 and the handle member 30. For example, a shock-absorbing bushing, plate, other structure, etc., may be provided between the long walls 48 of the outer arm section 38*b* and the end of the rivet 62. In another example, a shock-absorbing mount may be provided between the frame 14 and the adjacent arm section 38*c*.

In the illustrated construction, the mount 70 has the form of the hollow cylindrical (e.g., tubular) bushing 74 received in the circular opening 66 and receiving the cylindrical rivet 62. In other constructions, the mount 70 may have a different form factor. For example, with a square or rectangular pin (not shown), the mount 70 may include a pad (e.g., a flat isolation pad) engaging between the pin and the associated support structure (e.g., the opening in the latch body, the opening in the wall of the arm section, etc.).

In the illustrated construction, a shock-absorbing mount 70 is provided between each adjacent arm section 38 of each support arm 34 of the handle assembly 26. Accordingly, each additional connection and corresponding mount 70 increases the impact or shock reduction capability. In other constructions (not shown), a shock-absorbing mount 70 may be provided between only selected adjacent arm sections (e.g., between only the arm sections 38*b*, 38*c* closest to the frame 14).

One or more independent features and/or independent advantages of the invention may be set forth in the claims.

The invention claimed is:

1. A telescoping handle assembly for a mobile device, the handle assembly comprising:

a first handle section;

a second handle section telescopingly arranged relative to the first handle section; and a latch assembly fixed to one of the first handle section and the second handle section and selectively engageable with the other of the first handle section and the second handle section, the latch assembly including a latch body positioned between the first handle section and the second handle section, and a shock-absorbing mount positioned between the latch body and the one of the first handle section and the second handle section.

2. The handle assembly of claim 1, wherein the latch body defines a body opening, and wherein the shock-absorbing mount includes a cylindrical bushing received in the opening.

3. The handle assembly of claim 1, further comprising a fastener arranged to couple the latch assembly to the one of the first handle section and the second handle section.

4. The handle assembly of claim 3, wherein the shock-absorbing mount is positioned between the fastener and the latch body such that the fastener does not contact the latch body.

5. The handle assembly of claim 4, wherein the shock-absorbing mount includes a cylindrical bushing extending through the latch body and arranged to receive the fastener, wherein the one of the first handle section and the second handle section includes a wall defining a wall opening, and wherein the fastener extends through the opening to couple the latch assembly to the one of the first handle section and the second handle section.

6. The handle assembly of claim 1, wherein the first handle section includes a first elongated hollow member with a first cross-section and the second handle section includes a second elongated hollow member with a second cross-section, wherein the first cross-section is smaller than the second cross-section, and wherein the first handle section is slidingly received within the second handle section.

7. The handle assembly of claim 6, wherein the latch body is partially received in the first handle section, wherein the first handle assembly includes opposing walls, wherein the latch body defines a body opening, wherein a fastener extends through the opposing walls of the first handle section and the body opening to couple the latch assembly to the first handle section, and wherein the shock-absorbing mount is positioned in the body opening of the latch body between the fastener and the latch body.

8. The handle assembly of claim 1, wherein the shock-absorbing mount is made of thermoplastic polyurethane.

9. A wheeled mobile device comprising:

a frame;

a wheel assembly supporting the frame; and a telescoping handle assembly including a first handle section, a second handle section telescopingly arranged relative to the first handle section, and a latch assembly fixed to one of the first handle section and the second handle section and selectively engageable with the other of the first handle section and the second handle section, the latch assembly including a latch body positioned between the first handle section and the second handle section, and a shock-absorbing mount positioned between the latch body and the one of the first handle section and the second handle section.

10. The mobile device of claim 9, wherein the latch body defines a body opening, and wherein the shock-absorbing mount includes a cylindrical bushing received in the body opening.

11. The mobile device of claim 9, further comprising a fastener arranged to couple the latch assembly to the one of the first handle section and the second handle section.

12. The mobile device of claim 11, wherein the shock-absorbing mount is positioned between the fastener and the latch body such that the fastener does not directly contact the latch body.

13. The mobile device of claim 12, wherein the shock-absorbing mount includes a cylindrical bushing extending through the latch body and arranged to receive the fastener, wherein the one of the first handle section and the second handle section includes a wall defining a wall opening, and wherein the fastener extends through the wall opening to couple the latch assembly to the one of the first handle section and the second handle section.

14. The mobile device of claim 9, wherein the first handle section includes a first elongated hollow member with a first cross-section and the second handle section includes a second elongated hollow member with a second cross-section, wherein the first cross-section is smaller than the second cross-section, and wherein the first handle section is slidingly received within the second handle section.

15. The mobile device of claim 14, wherein the latch body is partially received in the first handle section, wherein the first handle section includes opposing walls, wherein the latch body defines a body opening, wherein a fastener extends through the opposing walls and the body opening to couple the latch assembly to the first handle section, and wherein the shock-absorbing mount is positioned within the body opening between the fastener and the latch body.

16. The mobile device of claim 9, wherein the shock-absorbing mount is made of thermoplastic polyurethane.

17. A method of assembling a telescoping handle assembly for a mobile device, the method comprising:

fixing a latch body of a latch assembly to one of a first handle section and a second handle section;

positioning a shock-absorbing mount between the latch body and the one of the first handle section and the second handle section; and inserting the one of the first handle section and the second handle section into the other of the first handle section and the second handle section in a telescoping arrangement with the latch assembly positioned in the other of the first handle section and the second handle section.

18. The method of claim 17, further comprising:

inserting the shock-absorbing mount within a body opening defined by the latch body; and extending a fastener through the opening in the latch body to couple the latch body to the one of the first handle section and the second handle section with the shock-absorbing mount positioned between the fastener and the latch body.

19. The method of claim 18, further comprising extending the fastener through openings in opposing walls of the one of the first handle section and the second handle section.

20. The method of claim 17, further comprising forming the shock-absorbing mount from thermoplastic polyurethane.

* * * * *